US007765900B2

(12) United States Patent
Wu

(10) Patent No.: US 7,765,900 B2
(45) Date of Patent: Aug. 3, 2010

(54) TORQUE WRENCH WHOSE TORQUE VALUES CAN BE ADJUSTED EASILY AND QUICKLY

(76) Inventor: Jih Chun Wu, No. 72, Chaoguei Rd., Situn District, Taichung (TW)

( * ) Notice: Subject to any disclaimer, the term of this patent is extended or adjusted under 35 U.S.C. 154(b) by 114 days.

(21) Appl. No.: 12/146,443

(22) Filed: Jun. 25, 2008

(65) Prior Publication Data

US 2009/0320654 A1 Dec. 31, 2009

(51) Int. Cl.
*B25B 23/14* (2006.01)

(52) U.S. Cl. ..... 81/467; 81/473; 81/475

(58) Field of Classification Search ..... 81/467, 81/472–478, 480–483; 73/862.22
See application file for complete search history.

(56) References Cited

U.S. PATENT DOCUMENTS 3,535,958 A * 10/1970 Larson ..... 81/475
3,772,942 A * 11/1973 Grabovac ..... 81/483
4,485,703 A * 12/1984 Grabovac et al. ..... 81/483
4,541,313 A * 9/1985 Wise ..... 81/478
5,152,200 A * 10/1992 Kaplan ..... 81/478
5,813,298 A * 9/1998 Beattie ..... 81/475
6,155,147 A * 12/2000 Dzieman ..... 81/473
6,640,674 B1 * 11/2003 Rinner et al. ..... 81/475
6,722,235 B2 * 4/2004 Hsieh ..... 81/478
6,945,144 B1 * 9/2005 Cutler et al. ..... 81/483
6,978,705 B1 * 12/2005 Lee ..... 81/467
7,000,508 B2 * 2/2006 Li et al. ..... 81/479
7,044,036 B1 * 5/2006 Salazar et al. ..... 81/483
7,275,467 B1 * 10/2007 Lee ..... 81/475

* cited by examiner

*Primary Examiner*—D. S Meislin
(74) *Attorney, Agent, or Firm*—Banger Shia

(57) ABSTRACT

A torque wrench includes an operation bar having a mounting sleeve, a hollow handle having an inner wall provided with a first toothed portion and a plurality of positioning grooves, and an adjusting unit including an adjusting knob movable relative the handle and having an outer wall provided with a second toothed portion detachably engaged with the first toothed portion of the handle and a positioning block detachably locked in one of the positioning grooves of the handle. Thus, the adjusting knob is initially pulled outwardly relative to the mounting sleeve and the linking rod and is then rotatable relative to the handle so as to adjust the torque values of the torque wrench.

13 Claims, 8 Drawing Sheets

TORQUE WRENCH WHOSE TORQUE VALUES CAN BE ADJUSTED EASILY AND QUICKLY

BACKGROUND OF THE INVENTION

1. Field of the Invention

The present invention relates to a wrench, and more particularly to a torque wrench whose torque values can be preset, fixed and adjusted.

2. Description of the Related Art

A conventional torque wrench is used to lock and detach a workpiece, such as a screw and the like. The torque wrench includes a plurality of preset torque values (such as pounds) so as to control the tightening extent of the workpiece to prevent the workpiece from being distorted or broken due to an excessive torque. The torque values of the torque wrench usually have a larger ranges, such as from 50 through 75 to 105 pounds. However, a user has to adjust the torque values of the torque wrench step by step to change the torque values successively from 50 through 75 to 105 pounds, thereby wasting the working time, and thereby causing inconvenience to the user in adjustment of the torque values of the torque wrench.

SUMMARY OF THE INVENTION

The present invention is to mitigate and/or obviate the disadvantage of the conventional torque wrench.

The primary objective of the present invention is to provide a torque wrench whose torque values can be adjusted easily and quickly.

Another objective of the present invention is to provide a torque wrench, wherein the adjusting knob of the adjusting unit is initially pulled outwardly relative to the mounting sleeve of the operation bar and the linking rod and is then rotatable relative to the end portion of the handle so as to adjust the torque values of the torque wrench.

A further objective of the present invention is to provide a torque wrench, wherein a user only needs to pull and rotate the adjusting knob of the adjusting unit so as to adjust the torque values of the torque wrench, so that the torque values of the torque wrench is adjusted easily and quickly, thereby facilitating the user adjusting the torque values of the torque wrench.

A further objective of the present invention is to provide a torque wrench, wherein the adjusting knob of the adjusting unit is rotatable freely to directly reach any one of the torque values of the torque wrench, so that the user can adjust the torque values of the torque wrench freely and selectively according to the user s requirement without have to adjust the torque values of the torque wrench step by step, thereby facilitating the user operating the torque wrench.

In accordance with the present invention, there is provided a torque wrench, comprising an operation bar having a first end provided with a mounting sleeve and a second end provided with a drive portion, a hollow handle mounted on the mounting sleeve of the operation bar and having an end portion having an inner wall provided with a first toothed portion and a plurality of positioning grooves, and an adjusting unit mounted on the handle and including an adjusting knob movable relative to the end portion of the handle and having an outer wall provided with a second toothed portion detachably engaged with the first toothed portion of the handle and a positioning block detachably locked in one of the positioning grooves of the handle to releasably lock the adjusting knob of the adjusting unit onto the end portion of the handle.

Further benefits and advantages of the present invention will become apparent after a careful reading of the detailed description with appropriate reference to the accompanying drawings.

DETAILED DESCRIPTION OF THE INVENTION

Figure 1:
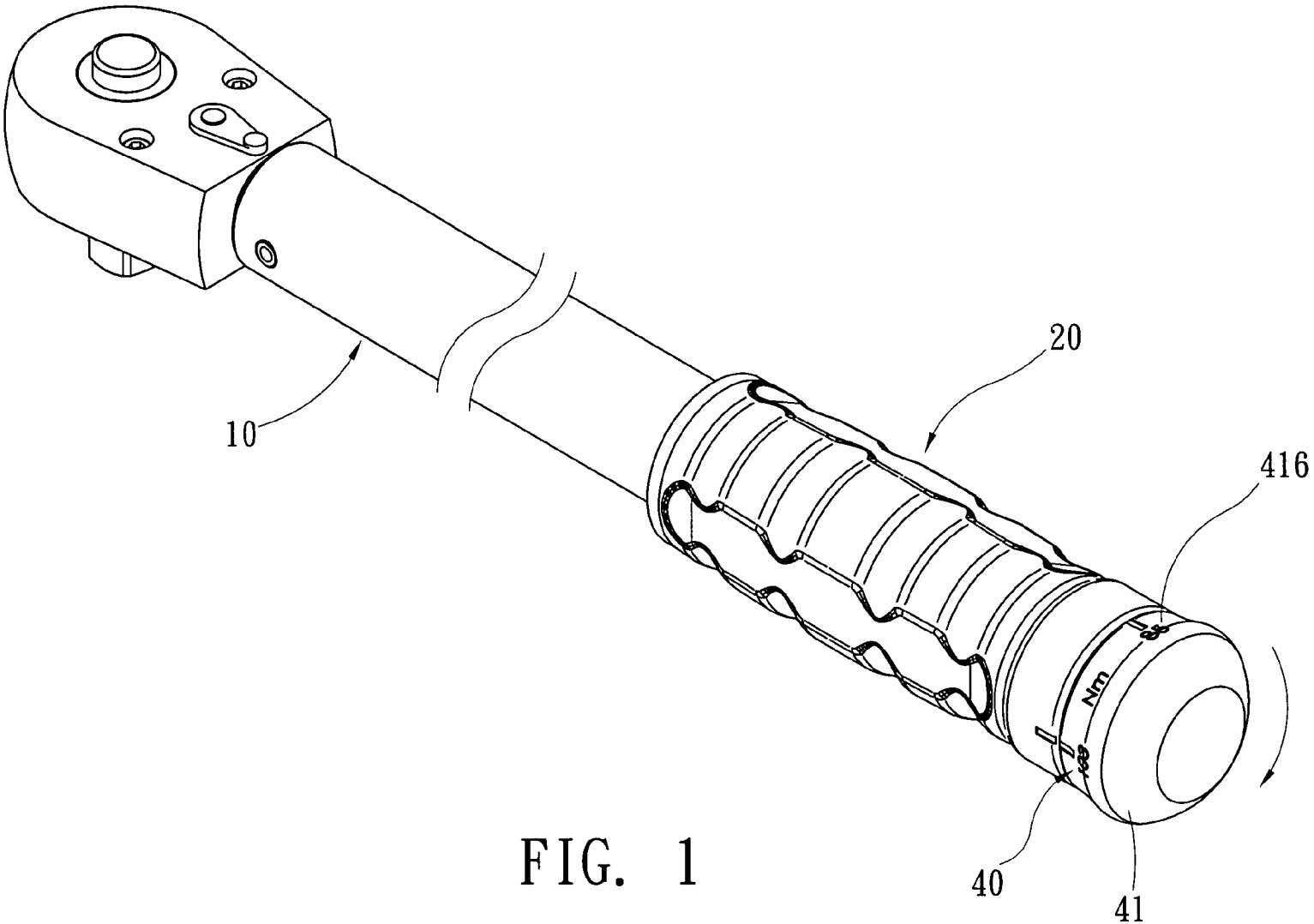
FIG. 1 is a perspective view of a torque wrench in accordance with the preferred embodiment of the present invention.
Figure 2:
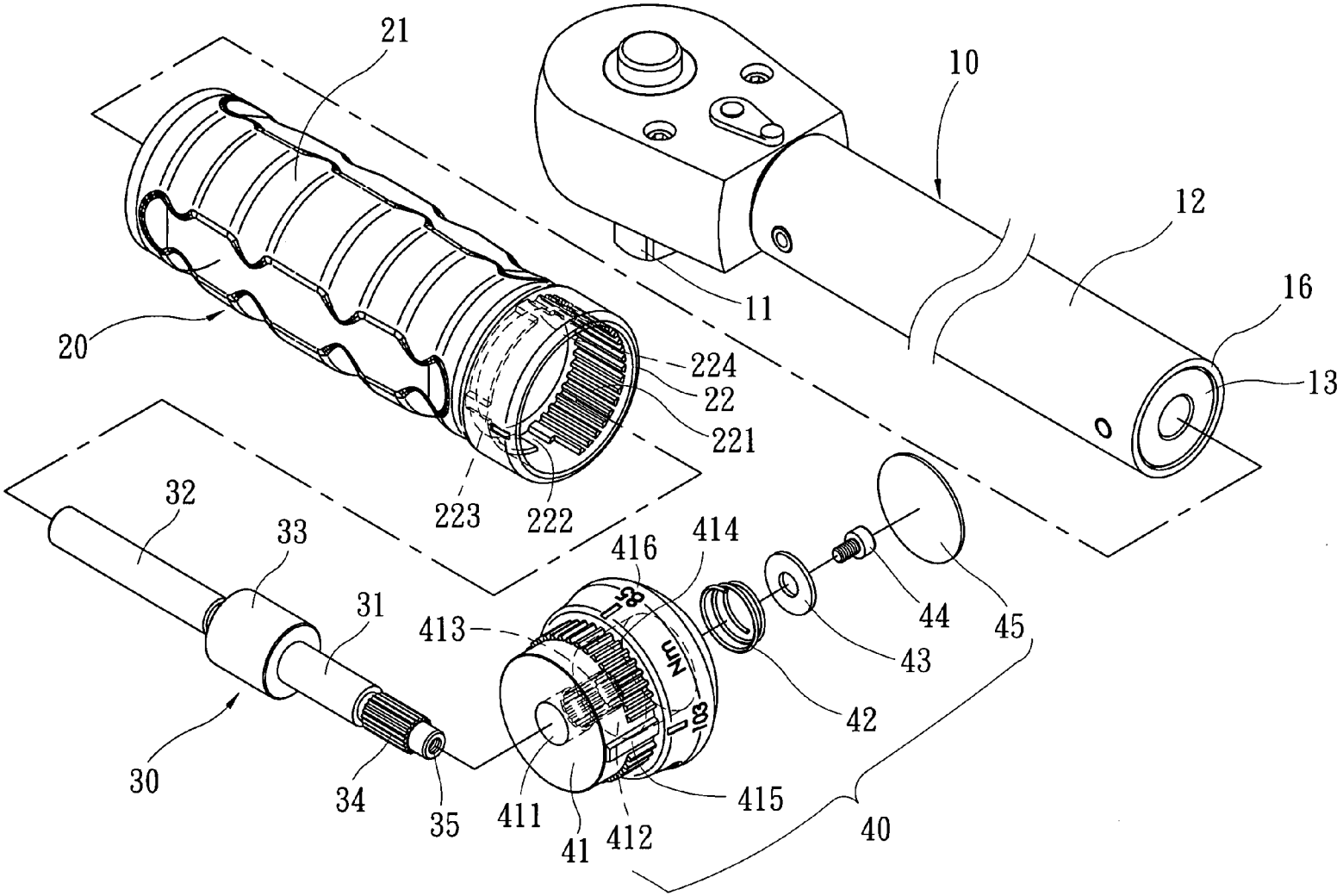
FIG. 2 is an exploded perspective view of the torque wrench as shown in FIG. 1.

Referring to the drawings and initially to FIGS. 1-5, a torque wrench in accordance with the preferred embodiment of the present invention comprises an operation bar 10 having a first end provided with a mounting sleeve 12 and a second end provided with a drive portion 11, a hollow handle 20 mounted on the mounting sleeve 12 of the operation bar 10 and having an end portion 22 having an inner wall provided with a first toothed portion 221 and a plurality of positioning grooves 222, 223 and 224, an adjusting unit 40 mounted on the handle 20 and including an adjusting knob 41 movable relative to the end portion 22 of the handle 20 and having an outer wall provided with a second toothed portion 414 detachably engaged with the first toothed portion 221 of the handle 20 and a positioning block 415 detachably locked in one of the positioning grooves 222, 223 and 224 of the handle 20 to releasably lock the adjusting knob 41 of the adjusting unit 40 onto the end portion 22 of the handle 20, and a linking rod 30 mounted in the mounting sleeve 12 of the operation bar 10 and attached to the adjusting knob 41 of the adjusting unit 40 to limit the adjusting knob 41 of the adjusting unit 40 on the mounting sleeve 12 of the operation bar 10.

The torque wrench further comprises a first bushing 13 mounted in the mounting sleeve 12 of the operation bar 10 and a second bushing 14 mounted in the mounting sleeve 12 of the operation bar 10, and the mounting sleeve 12 of the operation bar 10 has an inside defining a limit space 15 between the first bushing 13 and the second bushing 14.

The handle 20 has an outer wall provided with an elongate serrated anti-slip portion 21 to facilitate a user holding the handle 20. The end portion 22 of the handle 20 protrudes outwardly from the mounting sleeve 12 of the operation bar 10, and the inner wall of the end portion 22 of the handle 20 is provided with a stepped stop portion 225 flush with an end face 16 of the mounting sleeve 12 of the operation bar 10 to stop the adjusting knob 41 of the adjusting unit 40. The end portion 22 of the handle 20 has a ring shape, and the inner wall of the end portion 22 of the handle 20 has a first semi-circular periphery provided with the first toothed portion 221 and a second semi-circular periphery provided with the positioning grooves 222, 223 and 224. The positioning grooves 222, 223 and 224 of the handle 20 are equally spaced from each other.

The adjusting knob 41 of the adjusting unit 40 is movably mounted on the linking rod 30 and is movable axially relative to the mounting sleeve 12 of the operation bar 10 and the linking rod 30 to a position where the second toothed portion 414 of the adjusting knob 41 is detached from the first toothed portion 221 of the handle 20 and the positioning block 415 of the adjusting knob 41 is detached from one of the positioning grooves 222, 223 and 224 of the handle 20 to unlock the adjusting knob 41 of the adjusting unit 40 from the end portion 22 of the handle 20 so that the adjusting knob 41 of the adjusting unit 40 is rotatable relative to the end portion 22 of the handle 20. The adjusting knob 41 of the adjusting unit 40 has a first end extended into the end portion 22 of the handle 20 and provided with the second toothed portion 414 and the positioning block 415 and an enlarged second end protruding outwardly from the end portion 22 of the handle 20 and provided with a plurality of indicating numbers 416 each aligning with a respective one of the positioning grooves 222, 223 and 224 of the handle 20 when the positioning block 415 of the adjusting knob 41 is inserted into one of the positioning grooves 222, 223 and 224 of the handle 20. The adjusting knob 41 of the adjusting unit 40 has an inner wall having a first end provided with a through hole 411 movable on the linking rod 30 and a second end provided with a receiving chamber 417 connected to the through hole 411. The receiving chamber 417 of the adjusting knob 41 has a diameter greater than that of the through hole 411, and the inner wall of the adjusting knob 41 has a mediate portion provided with a stepped limit portion 412 located between the receiving chamber 417 and the through hole 411. The through hole 411 of the adjusting knob 41 has a periphery provided with a first serrated portion 413.

The adjusting unit 40 further includes a threaded retaining member 44 screwed onto the linking rod 30, an elastic member 42 mounted on the linking rod 30 and biased between the threaded retaining member 44 and the adjusting knob 41 to push the adjusting knob 41 toward the mounting sleeve 12 of the operation bar 10 and the end portion 22 of the handle 20, a washer 43 mounted on the linking rod 30 and located between the threaded retaining member 44 and the elastic member 42, and an end cap 45 mounted on the adjusting knob 41 to cover the threaded retaining member 44, the washer 43, the elastic member 42 and the linking rod 30. The threaded retaining member 44, the washer 43 and the elastic member 42 of the adjusting unit 40 are received in the receiving chamber 417 of the adjusting knob 41, and the end cap 45 of the adjusting unit 40 is mounted on an end portion of the receiving chamber 417 of the adjusting knob 41 to close the receiving chamber 417 of the adjusting knob 41. The elastic member 42 of the adjusting unit 40 is biased between the washer 43 and the limit portion 412 of the adjusting knob 41.

The linking rod 30 is rotatable in the mounting sleeve 12 of the operation bar 10 by rotation of the adjusting knob 41 of the adjusting unit 40 relative to the end portion 22 of the handle 20. The linking rod 30 has a first end 31 extending through the first bushing 13 and the through hole 411 of the adjusting knob 41 into the receiving chamber 417 of the adjusting knob 41 for mounting the elastic member 42 and the washer 43 of the adjusting unit 40, a second end 32 extending through the second bushing 14, and a mediate portion located between the first end 31 and the second end 32 and provided with an enlarged limit block 33 limited in the limit space 15 of the mounting sleeve 12 between the first bushing 13 and the second bushing 14. The first end 31 of the linking rod 30 has a peripheral wall provided with a second serrated portion 34 engaged with the first serrated portion 413 of the adjusting knob 41 and has an end face provided with a screw bore 35 into which the threaded retaining member 44 is screwed.

Figure 5:
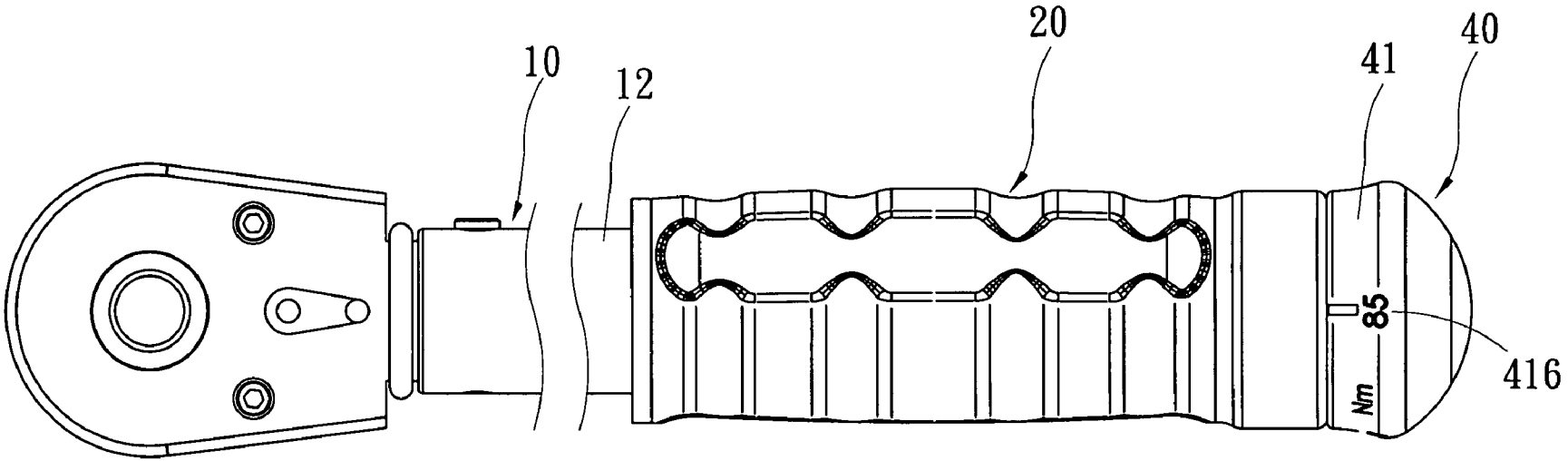
FIG. 5 is a top plan view of the torque wrench as shown in FIG. 1.

In operation, referring to FIGS. 5-8 with reference to FIGS. 1-4, when the second toothed portion 414 of the adjusting knob 41 is engaged with the first toothed portion 221 of the handle 20, and the positioning block 415 of the adjusting knob 41 is locked in a first one of the positioning grooves 222, 223 and 224 of the handle 20, the adjusting knob 41 of the adjusting unit 40 is locked onto the end portion 22 of the handle 20. At this time, a first one of the indicating numbers 416 is shown to indicate a first torque value of the torque wrench, such as 85 pounds, as shown in FIG. 5.

Figure 3:
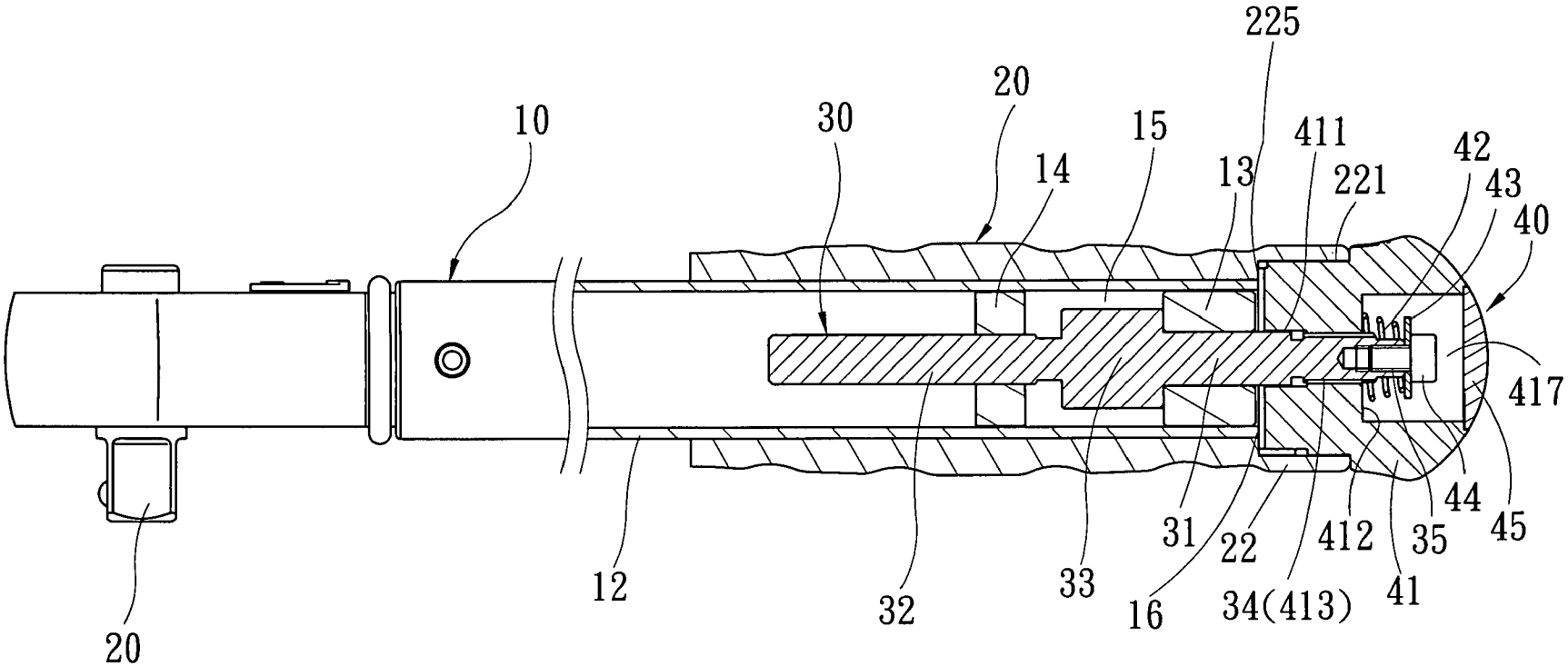
FIG. 3 is a front plan cross-sectional view of the torque wrench as shown in FIG. 1.
Figure 4:
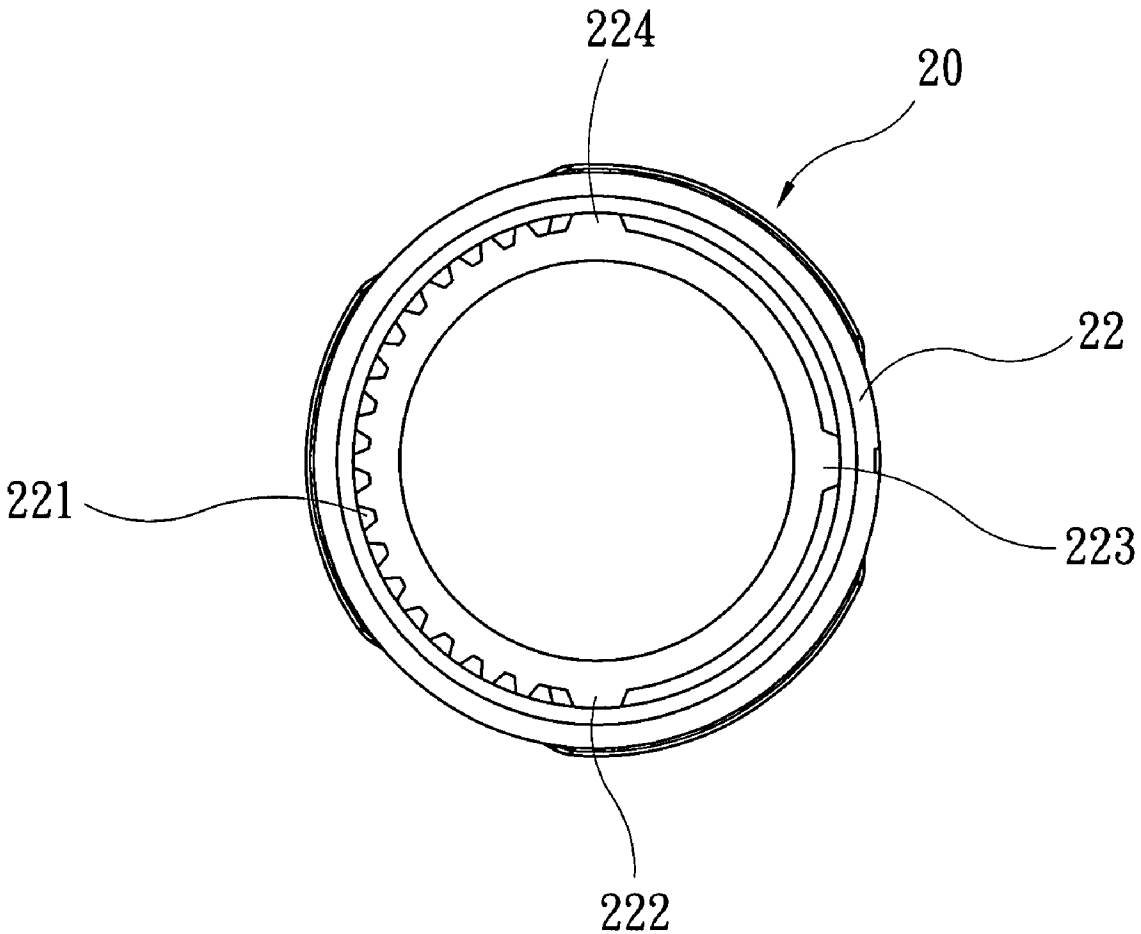
FIG. 4 is a side plan view of a handle of the torque wrench as shown in FIG. 2.
Figure 6:
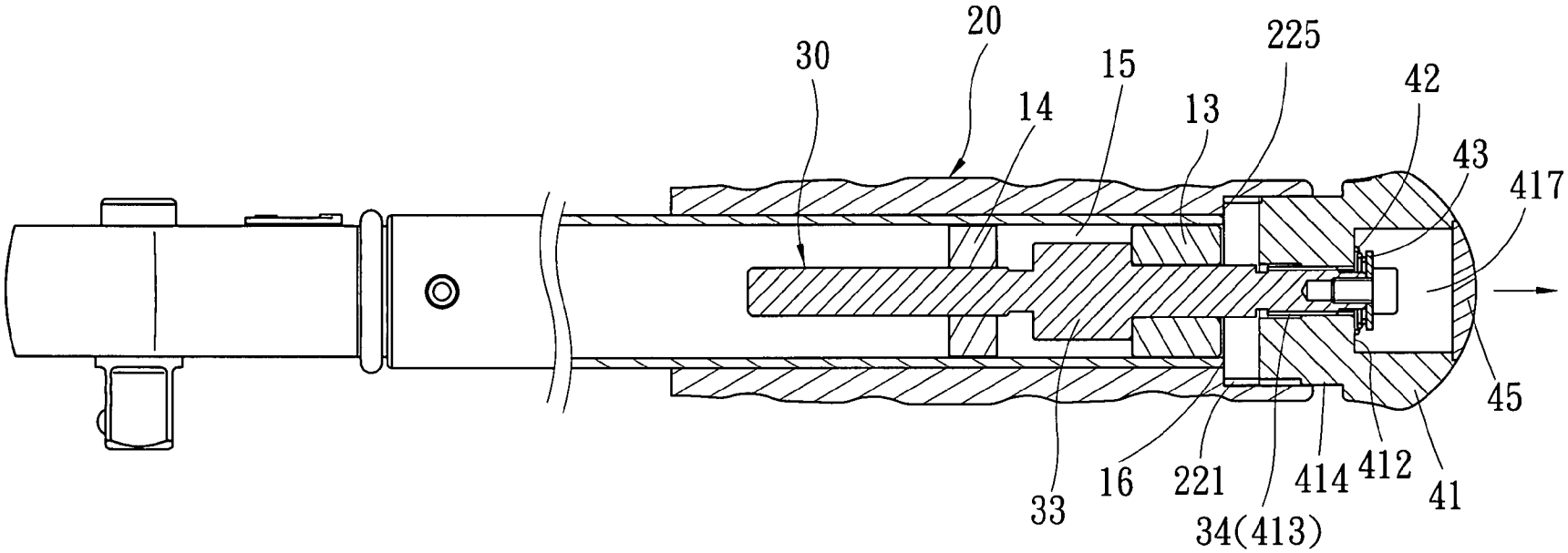
FIG. 6 is a schematic operational view of the torque wrench as shown in FIG. 3 in use.

Alternatively, when the adjusting knob 41 of the adjusting unit 40 is movable outwardly relative to the mounting sleeve 12 of the operation bar 10 and the linking rod 30 from the position as shown in FIG. 3 to the position as shown in FIG. 6, the second toothed portion 414 of the adjusting knob 41 is detached from the first toothed portion 221 of the handle 20 and the positioning block 415 of the adjusting knob 41 is detached from the first one of the positioning grooves 222, 223 and 224 of the handle 20 to unlock the adjusting knob 41 of the adjusting unit 40 from the end portion 22 of the handle 20, so that the adjusting knob 41 of the adjusting unit 40 is rotatable relative to the end portion 22 of the handle 20.

Figure 7:
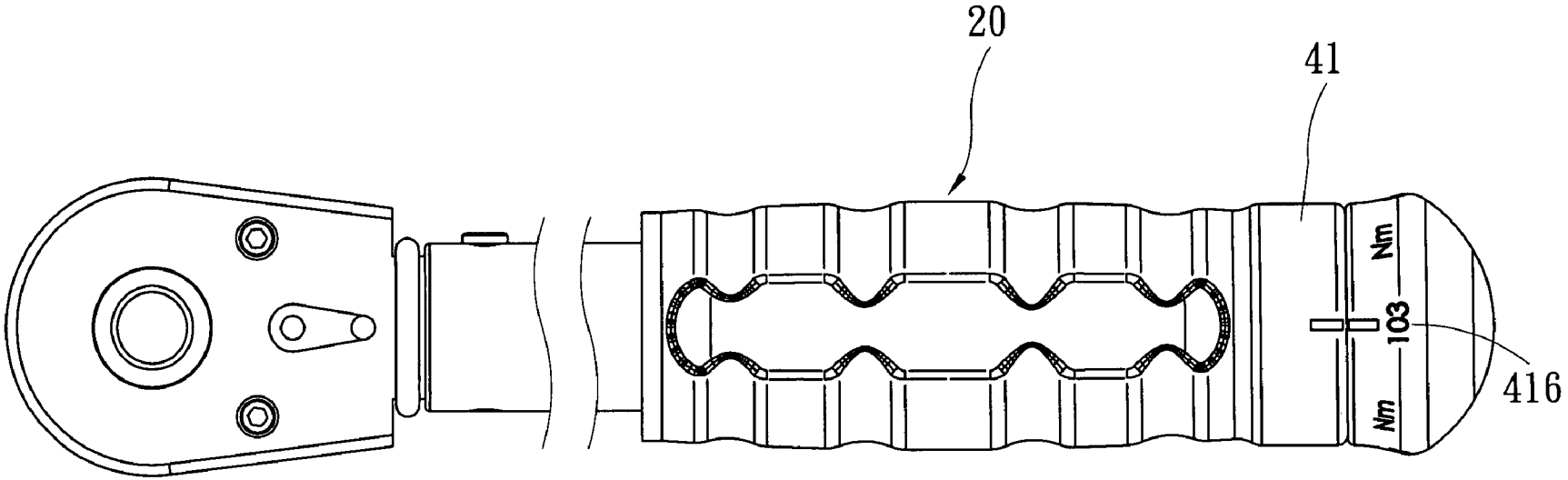
FIG. 7 is a schematic operational view of the torque wrench as shown in FIG. 5 in use.

In such a manner, when the positioning block 415 of the adjusting knob 41 is moved to align with a second one of the positioning grooves 222, 223 and 224 of the handle 20, the adjusting knob 41 of the adjusting unit 40 is pushed by the restoring force of the elastic member 42 to move toward the mounting sleeve 12 of the operation bar 10 and the linking rod 30 from the position as shown in FIG. 6 to the position as shown in FIG. 3, so that the second toothed portion 414 of the adjusting knob 41 is engaged with the first toothed portion 221 of the handle 20 again, and the positioning block 415 of the adjusting knob 41 is locked in the second one of the positioning grooves 222, 223 and 224 of the handle 20. At this time, a second one of the indicating numbers 416 is shown to indicate a second torque value of the torque wrench, such as 103 pounds, as shown in FIG. 7.

Alternatively, when the adjusting knob 41 of the adjusting unit 40 is movable outwardly relative to the mounting sleeve 12 of the operation bar 10 and the linking rod 30 from the position as shown in FIG. 3 to the position as shown in FIG. 6, the second toothed portion 414 of the adjusting knob 41 is detached from the first toothed portion 221 of the handle 20 and the positioning block 415 of the adjusting knob 41 is detached from the second one of the positioning grooves 222, 223 and 224 of the handle 20 to unlock the adjusting knob 41 of the adjusting unit 40 from the end portion 22 of the handle 20, so that the adjusting knob 41 of the adjusting unit 40 is rotatable relative to the end portion 22 of the handle 20.

Figure 8:
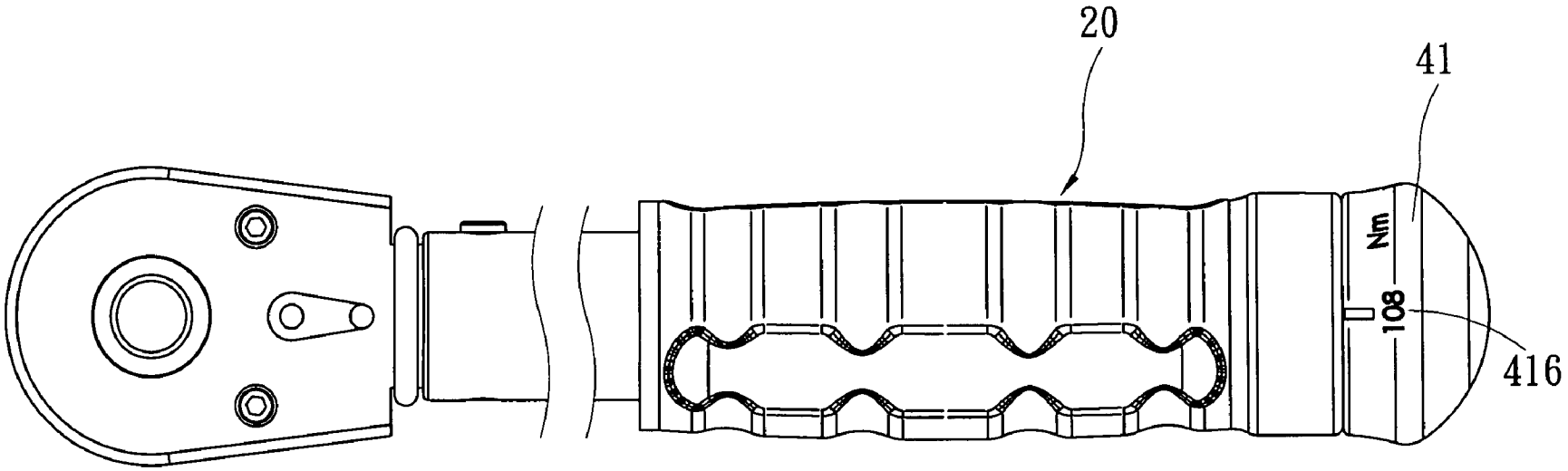
FIG. 8 is a schematic operational view of the torque wrench as shown in FIG. 7 in use.

In such a manner, when the positioning block 415 of the adjusting knob 41 is moved to align with a third one of the positioning grooves 222, 223 and 224 of the handle 20, the adjusting knob 41 of the adjusting unit 40 is pushed by the restoring force of the elastic member 42 to move toward the mounting sleeve 12 of the operation bar 10 and the linking rod 30 from the position as shown in FIG. 6 to the position as shown in FIG. 3, so that the second toothed portion 414 of the adjusting knob 41 is engaged with the first toothed portion 221 of the handle 20 again, and the positioning block 415 of the adjusting knob 41 is locked in the third one of the positioning grooves 222, 223 and 224 of the handle 20. At this time, a third one of the indicating numbers 416 is shown to indicate a second torque value of the torque wrench, such as 108 pounds, as shown in FIG. 8.

Accordingly, the adjusting knob 41 of the adjusting unit 40 is initially pulled outwardly relative to the mounting sleeve 12 of the operation bar 10 and the linking rod 30 and is then rotatable relative to the end portion 22 of the handle 20 so as to adjust the torque values of the torque wrench. In addition, a user only needs to pull and rotate the adjusting knob 41 of the adjusting unit 40 so as to adjust the torque values of the torque wrench, so that the torque values of the torque wrench is adjusted easily and quickly, thereby facilitating the user adjusting the torque values of the torque wrench. Further, the adjusting knob 41 of the adjusting unit 40 is rotatable freely to directly reach any one of the torque values of the torque wrench, so that the user can adjust the torque values of the torque wrench freely and selectively according to the user s requirement without have to adjust the torque values of the torque wrench step by step, thereby facilitating the user operating the torque wrench.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A torque wrench, comprising:

an operation bar having a first end provided with a mounting sleeve and a second end provided with a drive portion;

a hollow handle mounted on the mounting sleeve of the operation bar and having an end portion having an inner wall provided with a first toothed portion and a plurality of positioning grooves;

a first bushing located in the mounting sleeve;

a second bushing located in the mounting sleeve;

a linking rod located in the mounting sleeve; and an adjusting unit mounted on the handle and including:

an adjusting knob connected to the linking rod, movable relative to the end portion of the handle and having an outer wall provided with a second toothed portion detachably engaged with the first toothed portion of the handle, an inner wall including a through hole defined therein and a receiving chamber in communication with the through hole, and a positioning block detachably locked in one of the positioning grooves of the handle to releasably lock the adjusting knob of the adjusting unit onto the end portion of the handle;

a threaded retaining member screwed onto the linking rod;

an elastic member located on the linking rod and biased between the threaded retaining member and the adjusting knob to push the adjusting knob toward the mounting sleeve and the end portion of the handle;

a washer located on the linking rod and located between the threaded retaining member and the elastic member; and an end cap located on the adjusting knob to cover the threaded retaining member, the washer, the elastic member and the linking rod;

wherein the threaded retaining member, the washer and the elastic member are located in the receiving chamber of the adjusting knob;

wherein the end cap is located on an end portion of the receiving chamber to close the receiving chamber;

wherein the linking rod includes:

a first end extending into the receiving chamber via the first bushing and the through hole for positioning the elastic member and the washer; and a second end extending through the second bushing.

2. The torque wrench in accordance with claim 1, wherein the adjusting knob of the adjusting unit is movably mounted on the linking rod and is movable axially relative to the mounting sleeve of the operation bar and the linking rod to a position where the second toothed portion of the adjusting knob is detached from the first toothed portion of the handle and the positioning block of the adjusting knob is detached from one of the positioning grooves of the handle to unlock the adjusting knob of the adjusting unit from the end portion of the handle so that the adjusting knob of the adjusting unit is rotatable relative to the end portion of the handle.

3. The torque wrench in accordance with claim 1, wherein the inner wall of the adjusting knob has a mediate portion provided with a stepped limit portion located between the receiving chamber and the through hole;

the elastic member of the adjusting unit is biased between the washer and the limit portion of the adjusting knob.

4. The torque wrench in accordance with claim 1, wherein the through hole of the adjusting knob has a periphery provided with a first serrated portion;

the first end of the linking rod has a peripheral wall provided with a second serrated portion engaged with the first serrated portion of the adjusting knob.

5. The torque wrench in accordance with claim 1, wherein the first end of the linking rod has an end face provided with a screw bore into which the threaded retaining member is screwed.

6. The torque wrench in accordance with claim 1, wherein the mounting sleeve of the operation bar has an inside defining a limit space between the first bushing and the second bushing;

the linking rod has a mediate portion located between the first end and the second end and provided with an enlarged limit block limited in the limit space of the mounting sleeve between the first bushing and the second bushing.

7. The torque wrench in accordance with claim 1, wherein the receiving chamber of the adjusting knob has a diameter greater than that of the through hole.

8. The torque wrench in accordance with claim 1, wherein the linking rod is rotatable in the mounting sleeve of the operation bar by rotation of the adjusting knob of the adjusting unit relative to the end portion of the handle.

9. The torque wrench in accordance with claim 1, wherein the end portion of the handle has a ring shape;

the inner wall of the end portion of the handle has a first semi-circular periphery provided with the first toothed portion and a second semi-circular periphery provided with the positioning grooves.

10. The torque wrench in accordance with claim 9, wherein the positioning grooves of the handle are equally spaced from each other.

11. The torque wrench in accordance with claim 1, wherein the adjusting knob of the adjusting unit has a first end extended into the end portion of the handle and provided with the second toothed portion and the positioning block and an enlarged second end protruding outwardly from the end portion of the handle and provided with a plurality of indicating numbers each aligning with a respective one of the positioning grooves of the handle when the positioning block of the adjusting knob is inserted into one of the positioning grooves of the handle.

12. The torque wrench in accordance with claim 1, wherein the end portion of the handle protrudes outwardly from the mounting sleeve of the operation bar.

13. The torque wrench in accordance with claim 1, wherein the inner wall of the end portion of the handle is provided with a stepped stop portion flush with an end face of the mounting sleeve of the operation bar to stop the adjusting knob of the adjusting unit.

* * * * *